US005576810A

United States Patent [19]

Aita et al.

[11] Patent Number: 5,576,810

[45] Date of Patent: Nov. 19, 1996

[54] IMAGE FORMING METHOD

[75] Inventors: Shuichi Aita, Yokohama; Toshiyuki Yoshihara, Kawasaki; Tsutomu Kukimoto, Yokohama; Satoshi Yoshida, Tokyo; Yoshifumi Hano, Inagi; Yuki Nishio, Kawasaki, all of Japan

[73] Assignee: Canon Kabushiki Kaisha, Tokyo, Japan

[21] Appl. No.: 536,843

[22] Filed: Sep. 29, 1995

[30] Foreign Application Priority Data

Oct. 3, 1994 [JP] Japan ..... 6-238974
Oct. 3, 1994 [JP] Japan ..... 6-238975

[51] Int. Cl.[6] ..... G03G 15/04

[52] U.S. Cl. ..... 355/228; 347/129

[58] Field of Search ..... 355/228, 208, 355/214, 211; 347/129

[56] References Cited

U.S. PATENT DOCUMENTS

| | | | |
|---|---|---|---|
| 4,978,597 | 12/1990 | Nakahara et al. | 430/122 |
| 4,999,272 | 3/1991 | Tanikawa et al. | 430/106.6 |
| 5,009,973 | 4/1991 | Yoshida et al. | 430/45 |
| 5,025,272 | 6/1991 | Haneda et al. | 347/129 |

FOREIGN PATENT DOCUMENTS

| | | |
|---|---|---|
| 59-133573 | 7/1984 | Japan . |
| 62-203182 | 9/1987 | Japan . |
| 63-133179 | 6/1988 | Japan . |
| 64-20587 | 1/1989 | Japan . |
| 2302772 | 12/1990 | Japan . |
| 4155361 | 5/1992 | Japan . |
| 52287 | 1/1993 | Japan . |
| 52289 | 1/1993 | Japan . |
| 554382 | 3/1993 | Japan . |
| 561383 | 3/1993 | Japan . |

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

An electrophotographic image forming method including a toner image transfer step and eliminating an independent step for cleaning transfer residual toner is operated without causing ghost images and with good gradation and dot reproducibilities. In the method, the photosensitive member is exposed at an exposure intensity which is at least a minimum exposure intensity and below a maximum exposure intensity. The minimum exposure intensity is determined on a surface potential-exposure intensity characteristic curve of the photosensitive member by determining a first slope S1 of a straight line connecting a point giving a dark part potential Vd and a point giving a value of (Vd+ a residual potential Vr)/2, determining a contact point between a tangent line having a slope of S1/20 and the surface potential-exposure intensity characteristic curve and determining the minimum exposure intensity as an exposure intensity at the contact point. The maximum exposure intensity is determined as 5 times a half-attenuation exposure intensity.

50 Claims, 10 Drawing Sheets

IMAGE FORMING METHOD

FIELD OF THE INVENTION AND RELATED ART

The present invention relates to an image forming method which is suitably applicable to, e.g., a printer, a copying machine, a facsimile apparatus, etc., of the type which utilizes electrophotography adopting a reverse development scheme and does not require an independent cleaning device but utilizes a single member for development and residual toner recovery.

Hitherto, various electrophotographic processes have been known. In such processes, an electrostatic latent image is formed on a photosensitive member comprising a photoconductive material by various means, and is, developed with a toner to form a visual toner image. Subsequently, the resultant toner image is, after being transferred onto a transfer material such as paper, as desired, fixed, e.g., by application of heat and/or pressure, to obtain a copy or a print. Toner particles remaining on the photosensitive member, without being transferred onto the transfer material, are removed from the photosensitive member in a cleaning step.

In the cleaning step, a blade, a fur brush, a roller, etc., have been conventionally used as cleaning means. By cleaning means or member, the transfer residual toner is mechanically scraped off or held back to be recovered into a waste toner vessel. Accordingly, some problems have been caused by the pressing of such a cleaning member against the photosensitive member surface. For example, by strongly pressing the member, the photosensitive member can be worn out, resulting in a short life of the photosensitive member.

Further, from an apparatus viewpoint, the entire apparatus is naturally enlarged because of the provision of such a cleaning device, thus providing an obstacle against a general demand for a smaller apparatus.

Further, from an ecological viewpoint and effective utilization of a toner, a system not resulting in a waste toner has been desired.

On the other hand, a simultaneous developing and cleaning system or so-called cleaner-less system has been proposed, e.g., in Japanese Laid-Open Patent Application (JP-A) 5-2287, so as to solve image defects of positive ghost, negative ghost, etc., due to such transfer residual toner.

Now, an explanation as to how ghost images occur will be made.

In the case where a photosensitive member surface is repeatedly used for a sheet of transfer material, i.e., where one peripheral length of the photosensitive member is shorter than the length of the transfer material in the moving direction of the transfer material, a cycle of charging, exposing and developing has to be repeated on the photosensitive member for completing an image on the transfer material. In this instance, if some transfer residual toner is present locally on the photosensitive member, the photosensitive member at that part is not sufficiently exposed, thus failing to provide a sufficiently low potential and resulting in an insufficient developing contrast. In the case of reverse development mode, the insufficiently exposed part appears as a negative ghost having a lower density than the surrounding part in the final image. On the other hand, when a part of the photosensitive member subjected to insufficient cleaning retains some residual toner thereon and is subjected to a developing process, the part retaining the residual toner is further developed with a fresh toner resulting in a positive ghost having a higher image density than the surrounding part.

In the hitherto proposed cleaner-less systems as disclosed in JP-A 59-133573, JP-A 62-203182, JP-A 63-133179, JP-A 64-20587, JP-A 2-302772, JP-A 4-155361, JP-A 5-2289, JP-A 5-54382 and JP-A 5-61383, it has been proposed to obviate such ghost problems, e.g., by irradiating high-intensity light or using a toner transmitting a certain wavelength of the exposure light.

However, by only using such an intensified exposure light, latent image dots are liable to be blurred so that the reproducibility of individual dots can be impaired to result in an inferior resolution and a graphic image having insufficient gradation.

On the other hand, the use of a toner transmitting exposure wavelength light may allow light transmission through a fixed toner image which has been smoothened and is free from grain boundary but generally shows little effect because the interruption of exposure light is caused mainly by scattering at the toner particle surfaces rather than by the color of the toner per se. Further, this measure restricts the latitude of toner colorant selection and requires at least three exposure means issuing different wavelengths of light in the case of full color image formation. This is clearly against the object of providing a simpler apparatus, that is, a characteristic of the simultaneous development and cleaning system.

For the above reasons, the simultaneous development and cleaning systems, i.e., the cleanerless image forming systems, proposed heretofore do not show sufficient performances for image formation on various forms of transfer materials, inclusive of a thick paper liable to provide an inferior transfer efficiency and a transparency film for overhead projectors requiring a larger amount of toner than on ordinary paper. Further, in respects of image quality, because of an inferior individual dot reproducibility, satisfactory image qualities cannot be attained, e.g., for graphic images.

SUMMARY OF THE INVENTION

Accordingly, a principal object of the present invention is to provide an image forming method suitable for a simultaneous developing and cleaning system.

Another object of the present invention is to provide an image forming method capable of preventing positive or negative memory.

A further object of the present invention is to provide an image forming method capable of forming images with good individual dot reproducibility and excellent gradation characteristic.

According to the present invention, there is provided an image forming method, comprising:

a charging step of charging an electrophotographic photosensitive member, an exposure step of exposing the charged photosensitive member to form an electrostatic latent image thereon, a developing step of developing the electrostatic latent image with a toner to form a toner image, and a transfer step of transferring the toner image onto a transfer material, residual toner remaining on the photosensitive member after the transfer step being recovered in the developing step, wherein the photosensitive member is exposed in the exposure step at an exposure intensity which is at least a minimum exposure intensity and below a maximum exposure intensity; the minimum exposure intensity being determined on a surface potential-exposure intensity characteristic curve of the photosensitive member by determining a first slope S1 of a straight line connecting a point giving a dark part potential Vd and a point giving a value of (Vd+ a residual potential Vr)/2, determining a contact point between a tangent line having a slope of S1/20 and the surface potential-exposure intensity characteristic curve and determining the minimum exposure intensity as an exposure intensity at the contact point; the maximum exposure intensity being determined as 5 times a half-attenuation exposure intensity.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
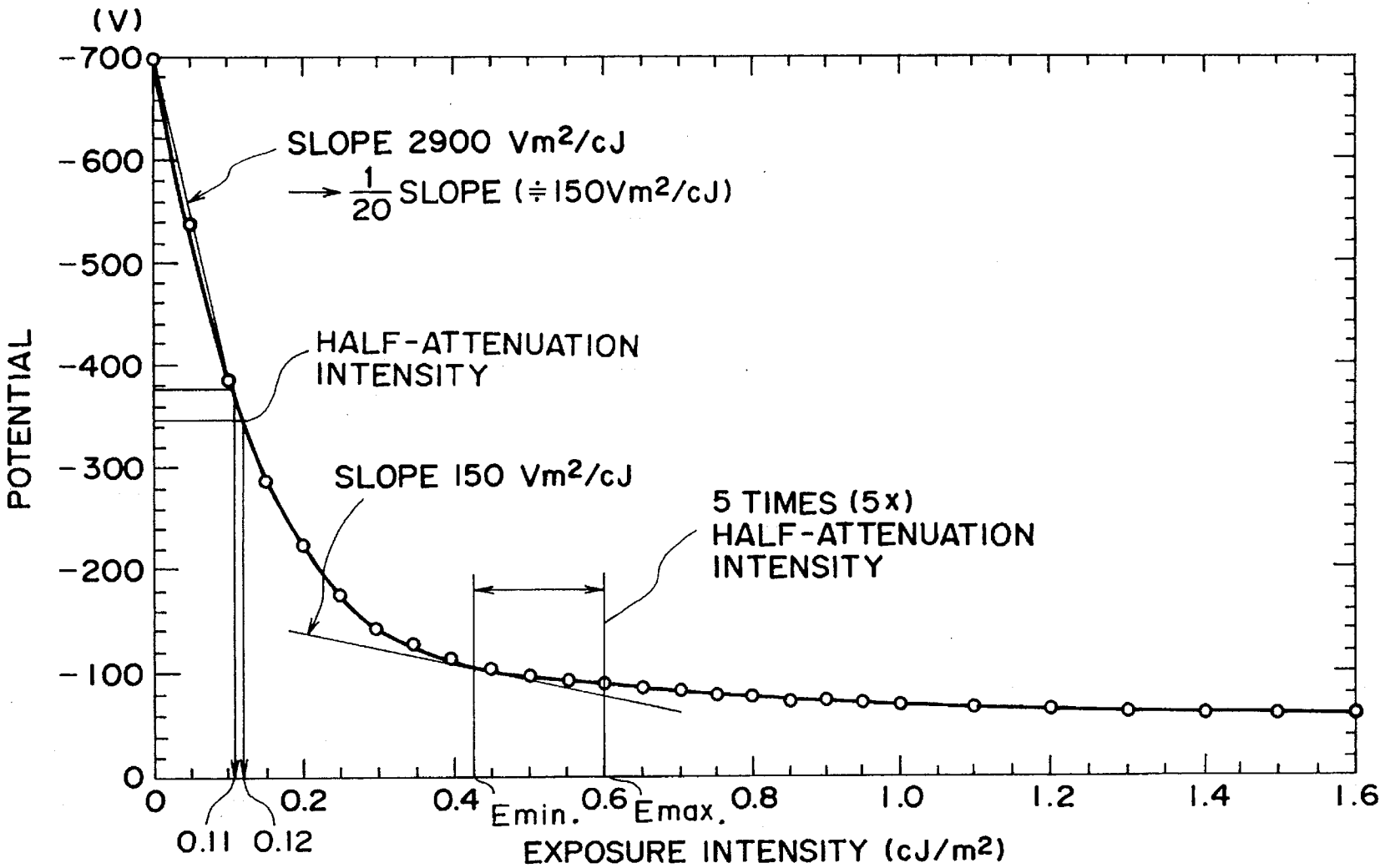
FIGS. 1 to 8 show surface potential-exposure intensity characteristic curves of photosensitive members obtained in Production Examples 1–8, respectively.
Figure 2:
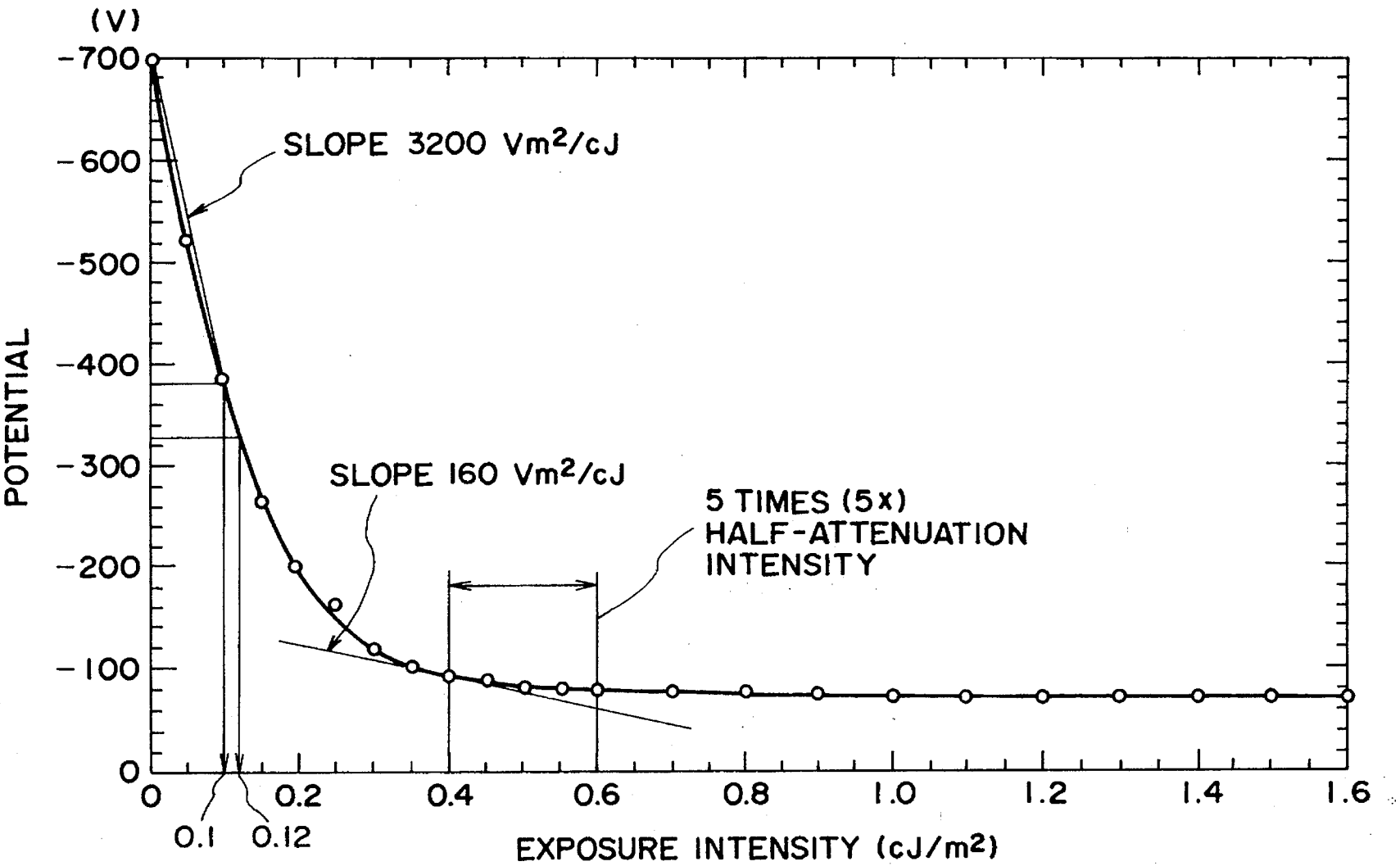
Figure 3:
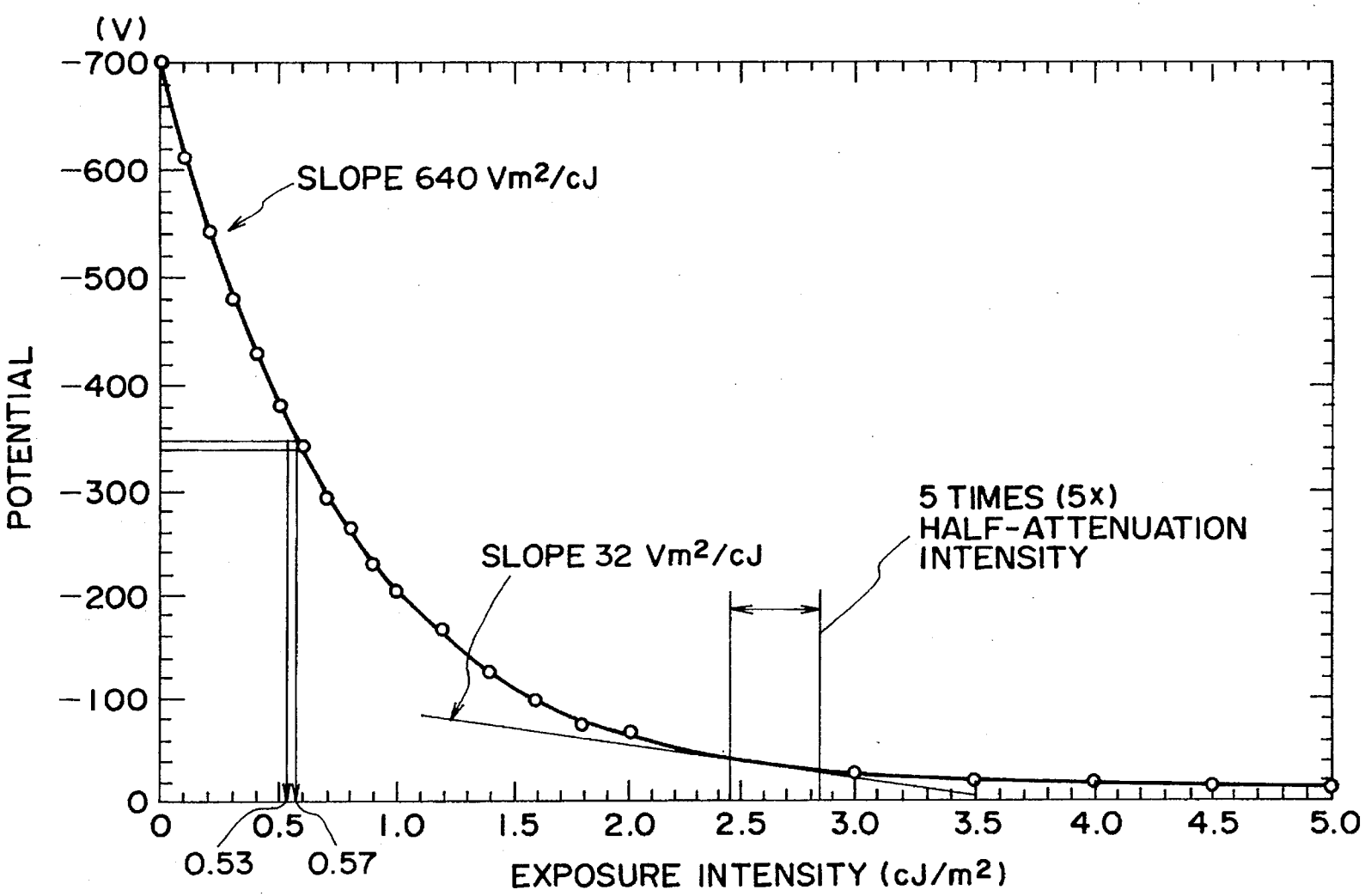
Figure 4:
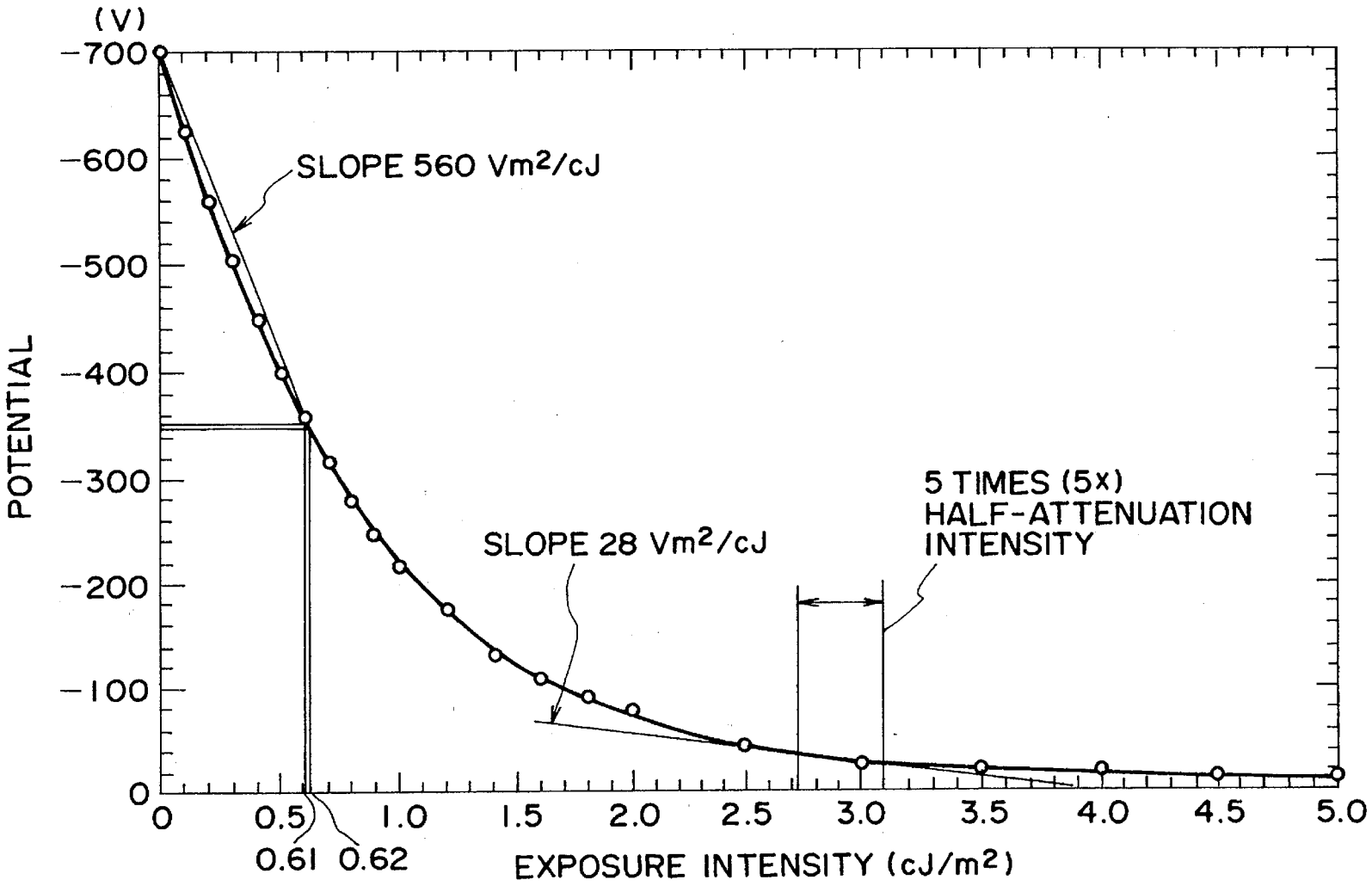
Figure 5:
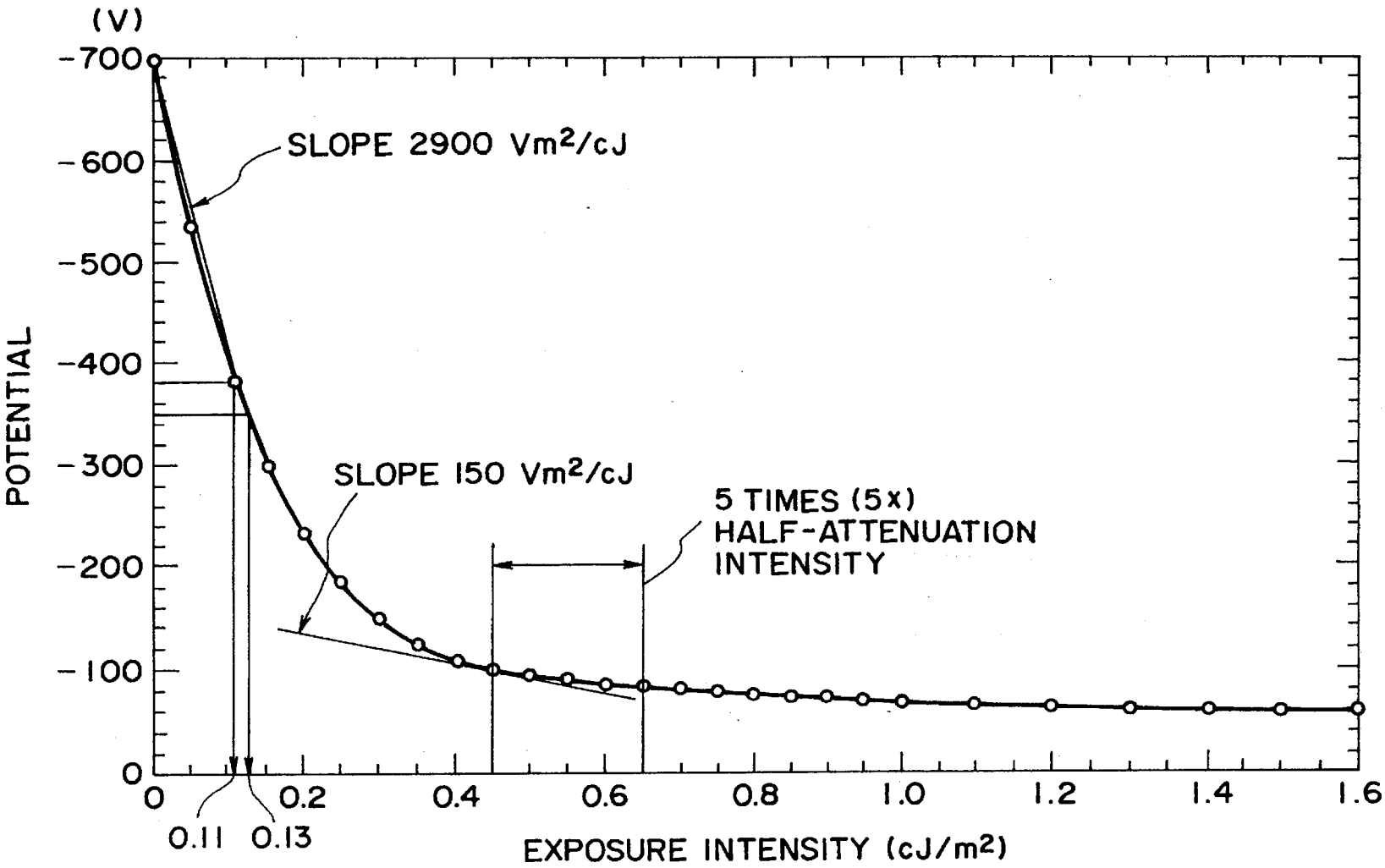
Figure 6:
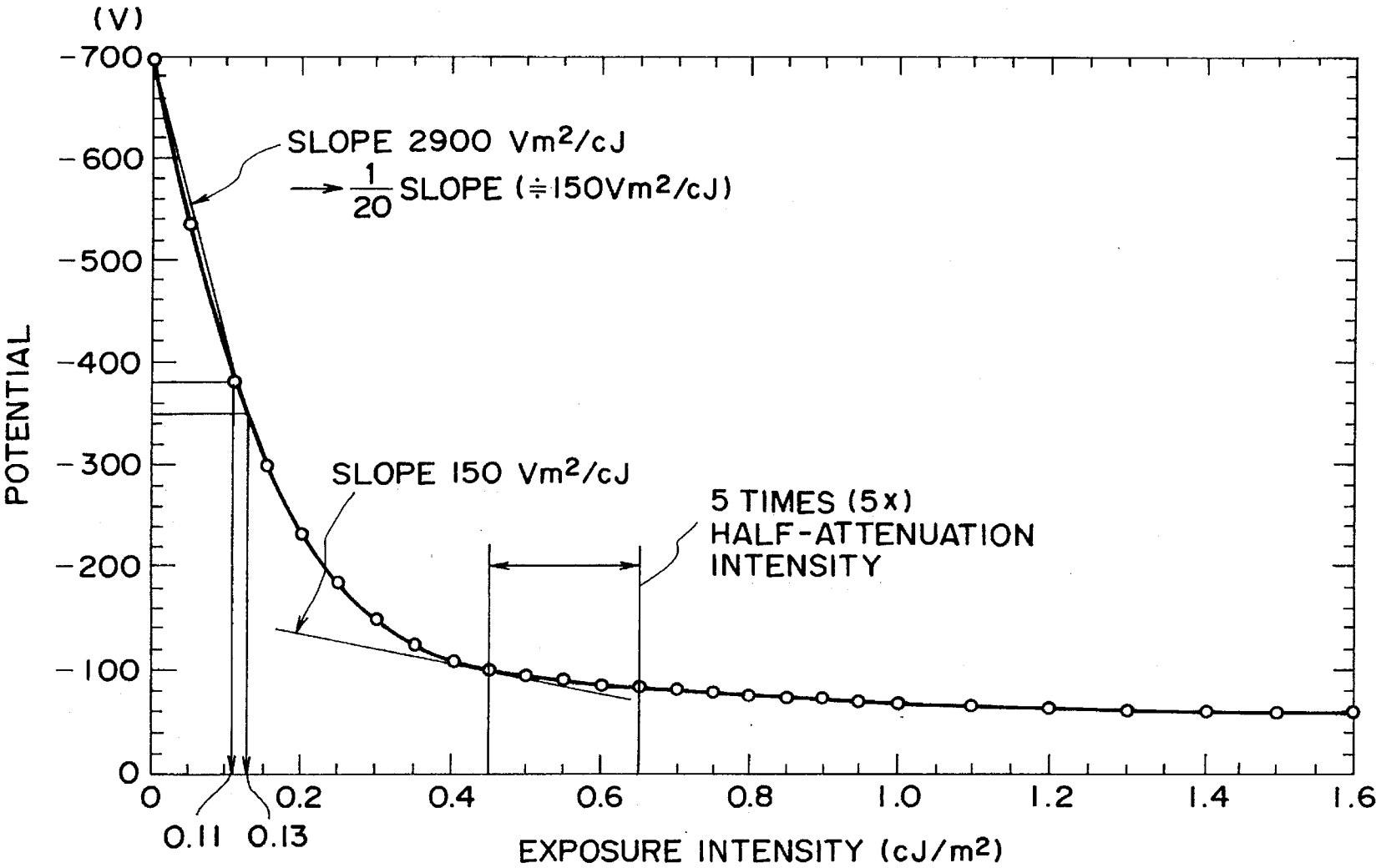
Figure 7:
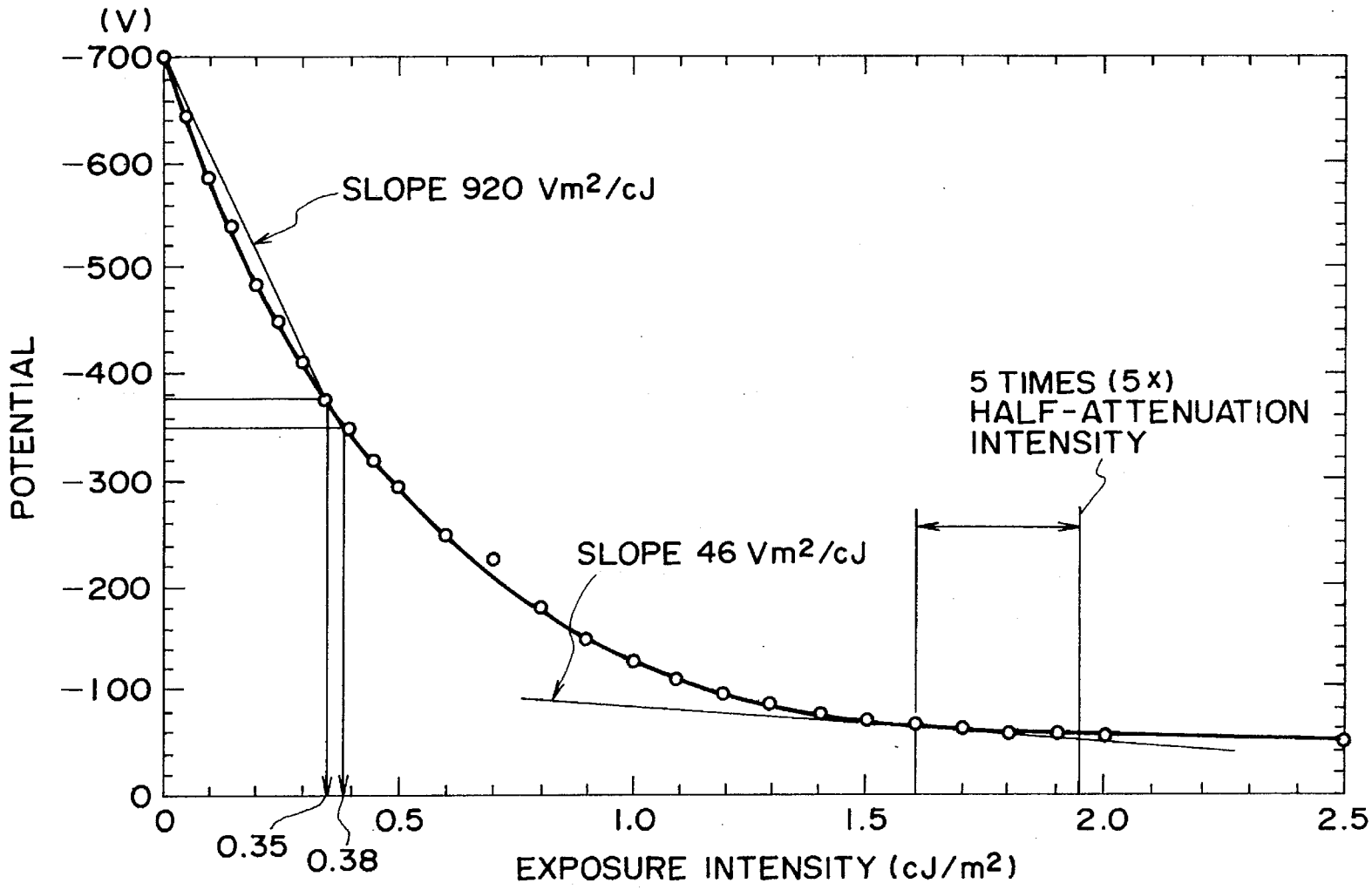
Figure 8:
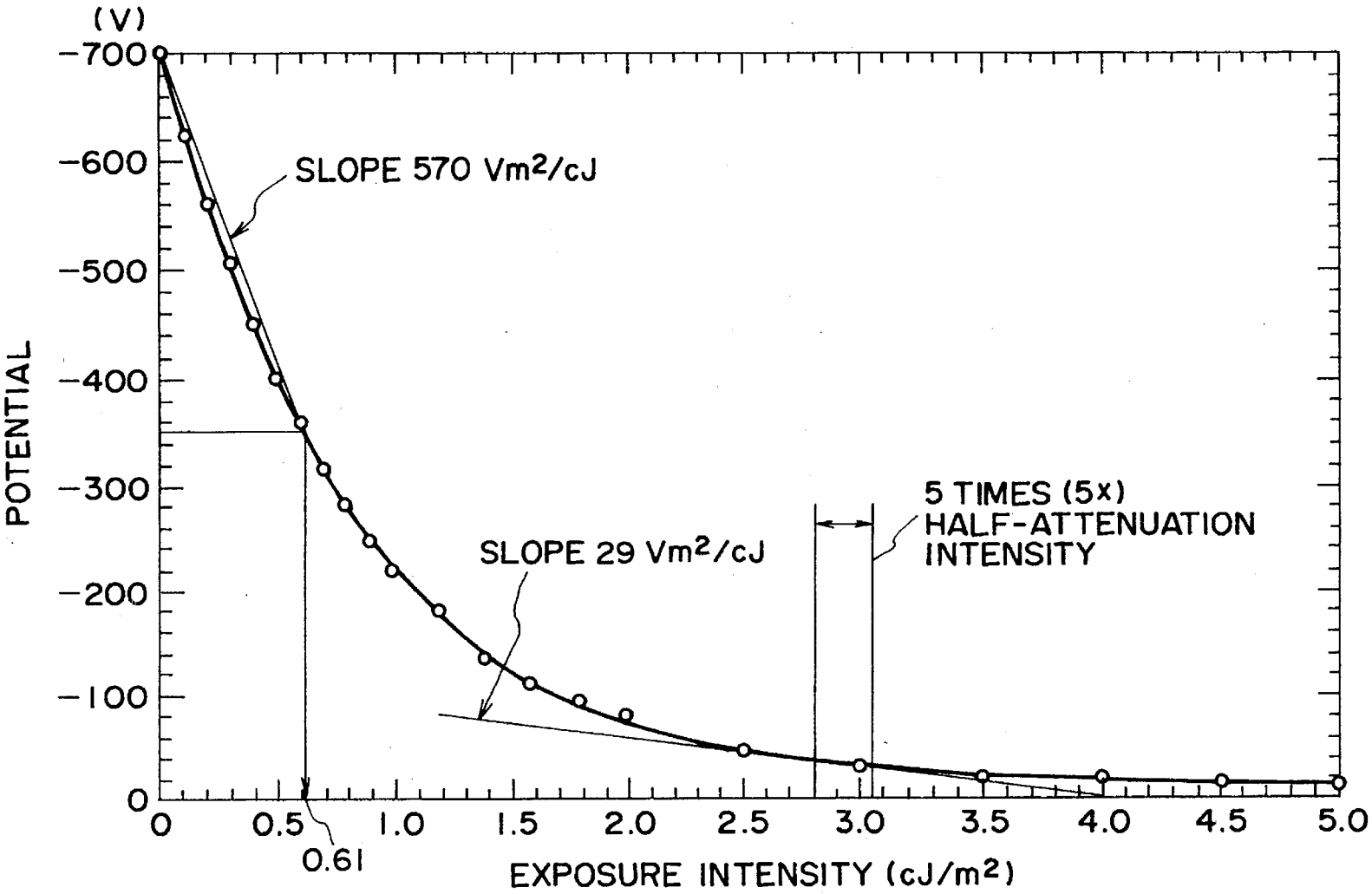

The image forming method according to the present invention includes a charging step of charging an electrophotographic photosensitive member, an exposure step of exposing the charged photosensitive member to form an electrostatic latent image thereon, a developing step of developing the electrostatic latent image with a toner to form a toner image, and a transfer step of transferring the toner image onto a transfer material. In the developing step, residual toner remaining on the photosensitive member after the transfer step is also recovered.

In the exposure step, the photosensitive member is exposed at an exposure intensity which is at least a minimum exposure intensity Emin. and below a maximum exposure intensity Emax. Emin. is determined on a surface potential-exposure intensity characteristic curve of the photosensitive member by determining a first slope S1 of a straight line connecting a point giving a dark part potential Vd and a point giving a value of (Vd+ a residual potential Vr)/2, determining a contact point between a tangent line having a slope of S1/20 and the surface potential-exposure intensity characteristic curve and determining the minimum exposure intensity as an exposure intensity at the contact point. On the other hand, Emax is determined as 5 times a half-attenuation (exposure) intensity on the surface potential-exposure intensity characteristic curve.

In the image forming method according to the present invention, if the exposure intensity is below the above-specified minimum exposure intensity Emin., the resultant image is accompanied with thinned or scratchy line images and is also accompanied by a ghost image. In the case where the exposure intensity is 5 times the half-attenuation intensity or above, ghost images may not occur, but individual dots are deformed to cause resolution failure and a lower gradation characteristic.

The surface potential-exposure intensity characteristic curve of an electrophotographic photosensitive member referred to herein is prepared based on data obtained under process conditions for actually using the photosensitive member. The measurement is performed by placing a probe of a surface potential meter at a position immediately after exposure to first measure a potential on the photosensitive member in the absence of exposure to provide a dark-part potential Vd. Then, the exposure intensity is gradually increased to successively measure and record the surface potential of the photosensitive member. The half-attenuation intensity is defined as an exposure intensity giving a surface potential of Vd/2, i.e., one half of the dark-part potential Vd. Further, the residual potential Vr is defined as a surface potential of the photosensitive member after exposure with an intensity of light which is 30 times the half-attenuation intensity.

In the present invention, even better individual dot reproducibility is given when a photosensitive member showing a half-attenuation intensity of at most 0.5 $cJ/m^2$ ($\mu J/cm^2$) is used. This is because such a high-sensitivity photosensitive member shows a smaller potential fluctuation in response to light interruption with the residual toner. A further better result is attained if the half-attenuation intensity is at most 0.3 $cJ/m^2$.

Further, a parameter calculated as the exposure intensity range (Emax–Emin.)/(half-attenuation intensity) may preferably be at least 0.7, further preferably at least 1.0 so as to provide a broader latitude of selecting exposure conditions.

The electrophotographic photosensitive member used in the present invention may be an ordinary one comprising at least a photosensitive layer on an electroconductive support.

An electroconductive support may generally comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet or film, or an endless belt.

Between the electroconductive support and the photosensitive layer, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethyleneacrylic acid copolymer, polyvinyl butyral, phenolic resin, casein, polyamide, copolymer nylon, glue, gelatin, polyurethane, or aluminum oxide. The thickness may preferably be ca. 0.1–10 μm, particularly ca. 0.1–3 μm.

The photosensitive layer may comprise a single layer containing both a charge-generation substance and a charge-transporting substance, or a laminated structure including a charge generation layer containing a charge generation substance, and a charge transport layer containing a charge transporting substance, in lamination.

The charge generation layer may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. Among these, phthalocyanine pigments are preferred, and oxytitanium phthalocyanine having a high sensitivity is particularly preferred.

The binder may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 μm, preferably 0.05–2 μm.

The charge transport layer has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may preferably be 0.5–40 μm. Examples of the charge transporting substance may include: polycyclic aromatic compounds having in their main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinyl-anthracene.

A photosensitive layer of a single layer structure may be formed by preparing a coating liquid containing the above-mentioned charge-generation substance and charge-transporting substance dispersed or dissolved together with the binder resin, and applying the coating liquid.

The photosensitive layer can be further coated with a protective layer comprising one or more species of a resin, such as polyester, polycarbonate, acrylic resin, epoxy resin, or phenolic resin together with its hardening agent, as desired.

Such a protective layer may further contain electroconductive fine conductive fine particles of metal or metal oxide, preferred examples of which may include ultrafine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in a mixture of two or more species. The protective layer can further contain insulating fine particles. Such particles dispersed in the protective layer may preferably have a particle size smaller than the wavelength of light incident thereon so as to prevent scattering of the incident light due to the dispersed particles. More specifically, the electroconductive or insulating particles dispersed in the present invention may preferably have a particle size of at most 0.5 μm. The content thereof may preferably be 2 –90 wt. %, further preferably 5–80 wt. %, of the total solid matter in the protective layer. The protective layer may preferably have a thickness of 0.1–10 μm, more preferably 1–7 μm.

The above-mentioned layers may be formed, e.g., by spray coating, beam coating or dip coating.

It is assumed that the above-mentioned ghost phenomenon is caused by insufficient lowering in potential at an exposed part during the latent image forming step due to transfer residual toner causing scattering or reflection of exposure light. Based on this, we have found that the combination of the following factors is effective for solving the problem:

1) to use a combination of an exposure intensity and a photosensitive member causing little potential fluctuation even when an effective exposure intensity (exposure quantity per unit area) on the photosensitive member is reduced due to scattering or reflection of exposure light at the time of latent image formation, 2) to reduce the amount of transfer residual toner.

Generally, particles attenuate light incident thereon due to scattering, reflection and absorption. In the case where particles are present in proximity with each other, secondary scattering and secondary reflection are caused. Accordingly, by satisfying the above factors in combination, ghost images can be synergistically reduced.

The electrophotographic photosensitive member used in the present invention may preferably show a content angle of at least 80 degrees, particularly at least 90 degrees, with respect to water. The contact angles referred to herein are based on values measured by using a contact angle meter ("Model CA-DS", available from Kyowa Kaimen Kagaku K.K.) together with pure water.

By satisfying the above contact angle condition, even when transfer paper is placed in a not-readily transferable condition due to moisture absorption in a high temperature-high humidity environment, the amount of transfer residual toner can be remarkably reduced. As a result, the light interruption due to transfer residual toner is almost removed to substantially prevent a negative ghost image. Further, the residual toner cleaning effect in the developing step is also enhanced, thus being able to prevent a positive ghost image.

As a measure for lowering the contact angle to provide the surface layer with an enhanced releasability, it is possible (1) to use a layer-constituting resin which per se has a low surface energy, (2) to add an additive imparting water-repellency or lipophilicity, or (3) to disperse powder of a highly lubricating material. The measure (1) may be accomplished by introducing a fluorine-containing group or a silicon-containing group into the resin. The measure (2) may be accomplished by using a surfactant, etc., as the additive. The measure (3) may be accomplished by adding powder of a fluorine-containing resin, such as polytetrafluoroethylene, polyvinylidene fluoride, or fluorocarbon. Among these, polytetrafluoroethylene is particularly suitable. In the present invention, it is preferred to adopt the measure (3) of dispersing powder of a lubricating material, such as a fluorine-containing resin.

In order to have the photosensitive member surface contain such powder, it is possible to form anew an uppermost layer containing such powder in a binder resin or dispersing such powder in an already present uppermost resinous layer.

The powder may preferably be added into the surface layer in an amount of 1–60 wt. %, further preferably 2–50 wt. %, of the total solid content in the surface layer. Below 1 wt. %, the residual toner-reducing effect is insufficient and the cleaning performance-improving effect is insufficient, so that the ghost preventing effect is liable to be insufficient. Above 60 wt. %, the surface layer is liable to lower its strength, and the incident light quantity to the photosensitive layer is liable to be lowered. The particles may preferably have a particle size of at most 1 μm, more preferably at most 0.5 μm, in view of image qualities. Above 1 μm, the clarity of line images is liable to be impaired due to scattering of the incident light.

The developing mode used in the developing step of the present invention is not basically limited but may preferably be a contact developing mode wherein a developer or a magnetic brush contacts the photosensitive member, because of applicability of a high voltage and utilization of an effect of scraping residual toner with such a developer brush. Further, the reverse development mode is preferred because of the simplicity of the apparatus.

In the present invention, a sleeve or roller carrying a toner or a magnetic brush and a toner can rotate in a direction identical or opposite to the rotation direction of the photosensitive member at a position of contact or proximity therebetween. In the case of the identical rotation direction, the carrying sleeve or roller may preferably rotate at a speed of 100% or more of the peripheral speed of the photosensitive member. Below 100%, the resultant image qualities are liable to be impaired. A higher peripheral speed provides a higher toner supply rate to the developing position and a higher frequency of attachment and detachment of the toner with respect to the latent image, thus increasing the repetition of peeling an unnecessary portion of toner from the toner and attachment of the toner onto a necessary part, to provide an image faithful to the latent image. In view of the simultaneous developing and cleaning performance, a higher peripheral speed ratio is preferred for convenience of residual toner recovery as it is possible to enjoy an effect of physically peeling the attached residual toner from the photosensitive member surface by the peripheral speed difference and recovering the peeled toner by an electric field.

For example, in the case of a reverse development mode of using a negatively chargeable photosensitive member and a negatively chargeable toner in the present invention, the visualized toner image is transferred onto a transfer material supplied with a positive voltage. In this instance, depending on the kind (thickness, resistivity, dielectric constant, etc.) of the transfer material and a relationship with the image area, the charging polarity of the transfer residual toner can range widely from positive to negative. However, because of a negative corona shower or discharge for primarily charging the negatively chargeable photosensitive member, even when not only the photosensitive member surface but also the residual toner is positively charged after the transfer step, they can be uniformly charged negatively. As a result, the negatively charged residual toner at the light-potential part to be developed with a toner remains thereon, and the residual toner at the dark-potential part not to be developed with a toner is attracted to the toner carrying member, such as a developing sleeve under the action of a developing electric field, so that the residual toner does not remain at the dark-potential part on the photosensitive member.

It is also possible to use a method of applying a toner as a monocomponent-type developer onto an elastic roller surface, etc. and causing it to contact the photosensitive member surface. In this instance, the toner may be magnetic or non-magnetic, but the contact between the toner and the photosensitive member surface is important. In this instance, as the simultaneous developing and cleaning may be effected by an electric field acting between the photosensitive member and the elastic roller opposite thereto via the toner, it is necessary that the elastic roller surface or the proximity thereof has a potential and exerts an electric field across a narrow gap between the photosensitive member surface and the toner-carrying surface. For this purpose, it is also possible to use an elastic roller comprising an elastic rubber controlled to have a medium-level resistivity so as to retain an electric field while preventing conduction with the photosensitive member surface, or to form a thin insulating surface layer on the electroconductive roller. It is also possible to use an electroconductive resin sleeve formed by coating the side of an electroconductive roller facing the photosensitive member surface with an insulating layer or to use an insulating sleeve having an electroconductive layer on its side not facing the photosensitive member.

In the case of using a two-component magnetic brush developing method, the carrier may comprise ferrite, magnetite or iron powder, or a coated product thereof with a resin, such as acrylic resin, silicone resin or fluorine-containing resin. In this instance, at the time of development or blanking before and after the development, a DC or AC bias is applied to provide a controlled potential capable of simultaneous effecting development and recovery of residual toner on the photosensitive member. In this instance, the DC component is positioned between the light-part potential and the dark-part potential.

The toner used in the present invention may be of any type but may preferably carry inorganic fine powder on its surface so as to provide an improved transfer efficiency.

Examples of the inorganic fine powder may include powder of colloidal silica, titanium oxide, iron oxide, aluminum oxide, magnesium oxide, calcium titanate, barium titanate, strontium titanate, magnetism titanate, cerium oxide, and zirconium oxide. These may be used singly or in mixture of two or more species.

The binder resin for constituting the toner used in the present invention may be one or plural species of widely known resins, such as styrene resins, polyester resins, acrylic resins, phenolic resin and epoxy resin.

The colorant may also be an inorganic or organic dye or pigment known conventionally. Examples thereof may include: carbon black, aniline black, acetylene black, Naphthol Yellow, Hansa Yellow, Rhodamine Lake, Alizarine Lake, red iron oxide, Phthalocyanine Blue and Indanthrene Blue. These colorants may ordinarily be used in 0.5–20 wt. parts per 100 wt. parts of the binder resin.

Further, for the purpose of chargeability control, it is possible to add nigrosine dye, quaternary ammonium salt; or salicylic acid metal complex or salt, or acetylacetone metal complex.

The toner used in the present invention may be prepared according to a known process, e.g., by blending the binder resin, wax, metal salt or complex, pigment, dye a magnetic material as a colorant, and optional charge control agent and other additives in a blender, such as a Henschel mixer on a ball mill, and melt-kneading the blend by a hot kneading means, such as hot rollers, kneader or extruder, to disperse or dissolve the metal compound, pigment or dye or magnetic material in the kneaded resins, followed further by cooling for solidification, pulverization and classification, to prepare a toner used in the present invention.

The toner may be constituted as a magnetic or non-magnetic monocomponent developer, or may be further blended with carrier particles to constitute a two-component type developer.

The charging step may adopt a conventional one. In the present invention, however, it is particularly suitable to adopt a brush charging method using a fur brush or a magnetic brush as a charging means because the brush has an effect of scraping off the residual toner or taking the toner therein.

The exposure step used in the present invention need not be particularly restricted provided that the required exposure intensity control can be effected. However, one using a laser beam exposure is particularly preferred in view of availability of a small spot diameter and power. The exposure intensity control in the present invention may preferably be effected according to a binary mode wherein a whole latent image on a photosensitive member is formed by a combination of no exposure and exposure at a prescribed single level of exposure energy rather than an analog or multi-level exposure intensity mode using multiple levels of exposure intensities for forming a whole image.

The transfer step used in the present invention is not particularly restricted.

Hereinbelow, the present invention will be described based on Examples.

Production Example 1

Photosensitive member

A photosensitive member was prepared by coating an aluminum cylinder of 30 mm diameter and 254 mm length (as an electroconductive support) successively with the following layers.

(1) Electroconductive coating layer:

Formed in a thickness of 15 μm with phenolic resin containing powder of tin oxide and titanium oxide dispersed therein.

(2) Undercoating layer:

Formed in a thickness of 0.6 μm with modified nylon and copolymer nylon.

(3) Charge generation layer:

Formed in a thickness of 0.6 μm with butyral resin containing oxytitanium phthalocyanine dispersed therein having an absorption in a long-wavelength region.

(4) Charge transport layer:

Formed in a thickness of 20 μm by applying a coating liquid obtained by dissolving a hole-transporting triphenylamine compound and polycarbonate resin (having a molecular weight of 20,000 according to an Ostwald viscometer) in a weight ratio of 8:10 and further uniformly dispersing polytetrafluoroethylene powder (particle size: 0.2 μm) in 5 wt. % of the total solid content. The surface layer showed a contact angle θ with water of 93 degrees.

Production Example 2

A photosensitive member was prepared in the same manner as in Production Example 1 up to the formation of the charge generation layer. A 18 μm-thick charge-transport layer was formed thereon with a mutually dissolved 10:10 weight mixture of the hole-transporting triphenylamine compound and the polycarbonate resin, and further coated with a 3 μm-thick protective layer formed by applying a coating liquid obtained by dissolving the same triphenylamine compound and polycarbonate resin in a weight ratio of 5:10 and further uniformly dispersing polytetrafluoroethylene powder (particle size: 0.2 μm) in 30 wt. % of the total solid content. The protective layer showed a contact angle θ with water of 101 degrees.

Production Example 3

A photosensitive member was prepared in the same manner as in Production Example 1 except that the charge generation layer and the charge transport layer were formed as follows.

(3) Charge generation layer:

Formed in a thickness of 0.6 μm with butyral resin containing an azo pigment dispersed therein having an absorption in a long-wavelength region.

(4) Charge transport layer:

Formed in a thickness of 20 μm by applying a coating liquid obtained by dissolving a hole-transporting triphenylamine compound and polycarbonate resin (having a molecular weight of 20,000 according to an Ostwald viscometer) in a weight ratio of 8:10 and further uniformly dispersing polytetrafluoroethylene powder (particle size: 0.2 μm) in 10 wt. % of the total solid content. The surface layer showed a contact angle θ with water of 96 degrees.

Production Example 4

A photosensitive member was prepared in the same manner as in Production Example 3 except for omitting the polytetrafluoroethylene powder from the charge transport layer. The surface layer showed a contact angle with water of 74 degrees.

Production Example 5

A photosensitive member was prepared in the same manner as in Production Example 1 except for omitting the polytetrafluoroethylene powder from the charge transport layer. The surface layer showed a contact angle with water of 78 degrees.

Production Example 6

A photosensitive member was prepared in the same manner as in Production Example 5 except that the charge transport layer was formed in a thickness of 25 μm by changing the weight ratio between the triphenylamine compound and the polycarbonate resin to 9:10. The surface layer showed a contact angle θ with water of 77 degrees.

Production Example 7

A photosensitive member showing a contact angle θ with water of 77 degrees was prepared in the same manner as in Production Example 5 except that the charge generation layer and the charge transport layer were formed as follows.

(3) Charge generation layer:

Formed in a thickness of 0.5 μm with butyral resin containing oxytitanium phthalocyanine showing an absorption in a long-wavelength region.

(4) Charge transport layer:

Formed in a thickness of 24 μm with a 9:10 weight mixture of a hole-transporting hydrazone compound and the polycarbonate resin.

Production Example 8

A photosensitive member was prepared in the same manner as in Production Example 3 except that the the charge transport layer was formed in a thickness of 25 μm without adding the polytetrafluoroethylene powder. The surface layer showed a contact angle θ with water of 76 degrees.

Production Example 9

A photosensitive member was prepared in the same manner as in Production Example 1 except that the amount of the polytetrafluoroethylene powder was changed to 2 wt. %. The surface layer showed a contact angle with water of 88 degrees.

The surface potential-exposure intensity characteristics of the photosensitive members prepared in the above Production Examples were measured in the above-described manner.

More specifically, each sample photosensitive member was charged to a prescribed dark-part potential and the exposed to laser light having a wavelength identical to that of a laser of a laser beam printer ("LBP-860", mfd. by Canon) used in Examples appearing hereinafter continuously. Thereafter, the resultant surface potential was measured. By repeating the operation at various exposure intensities, a surface potential-exposure intensity characteristic curve was obtained for a sample photosensitive member.

FIG. 1 shows a surface potential-exposure intensity characteristic curve of the photosensitive member obtained in Production Example 1 obtained by taking the dark-part potential at −700 volts. As shown in FIG. 1, the half-attenuation intensity E1/2 (i.e., an exposure intensity by which the dark-potential was lowered to a half thereof (i.e., −350 volts) was 0.12 cJ/cm$^2$. The residual potential Vr (i.e., a potential given by irradiation with 30 times the half-attenuation intensity (=3.6 cJ/m$^2$)) was −55 volts. A first slope given by connecting a point of Vd and a point at a potential of (Vd+Vr)/2 (=(−700−55)/2=−378 volts) was about (−378+700)/0.11 =ca. 2900 volt m$^2$/cJ. Accordingly, a second slope was ca. 150 Vm$^2$/cJ (=2900/20). Emin given at a contact point between a tangential line having the slope 150 Vm/cJ and the characteristic curve was 0.43 cJ/m$^2$, and Emax was 0.60 cJ/m$^2$ (=0.12×5)

Similar measurements of the surface potential-exposure intensity characteristics and determination of the parameters were performed with respect to the photosensitive members prepared by Production Examples 2–9. The results are summarized in the following Table 1 and the surface potential-exposure intensity characteristic curves for the photosensitive members of Production Examples 1–8 are shown in FIGS. 1–8, respectively.

The above ingredients were dry blended and then melt-kneaded through a twin-screw kneading extruder set at 150° C. The kneaded product was cooled and then finely pulverized by a pneumatic pulverizer, followed by classification by a melt-division classifier to form toner particles having an average surface potential of 8.0 μm. Then, hydrophobic silica fine particles having a BET specific surface area of 200 m$^2$/g were externally added in an amount of 2.5 wt. % to the toner particles to obtain a toner having weight-average particles size of 8.0 μm.

Production Example II

A toner was prepared in the same manner as in Production Example I except for using a salicylic acid derivative metal salt instead of the metal-containing azo dye.

By using the above-prepared photosensitive members and developers, image formation was performed according to the following Examples.

EXAMPLE 1

Figure 9:
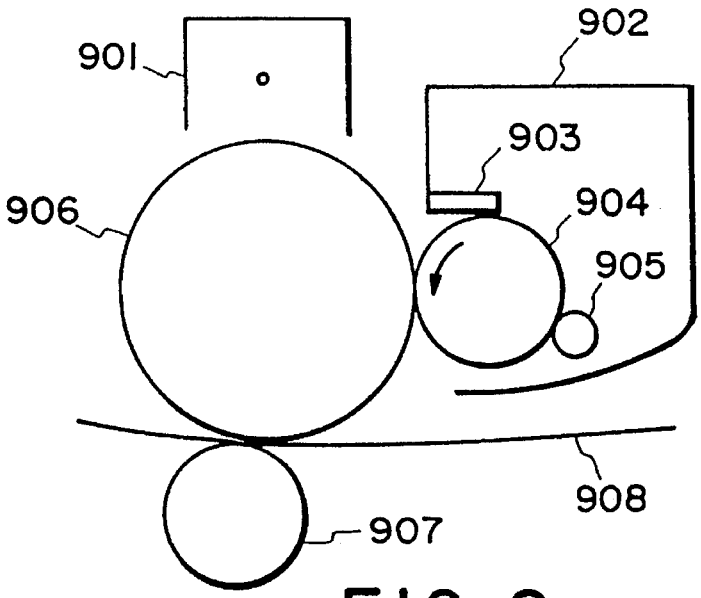
FIG. 9 is a schematic illustration of an image forming apparatus for practicing an embodiment of the image forming method according to the present invention.

A laser beam printer ("LBP-860", available from Canon K.K.) was used as an electrophotographic apparatus after remodelling. More specifically, the laser beam printer was remodeled into a form as briefly illustrated in FIG. 9.

First of all, the cleaning rubber blade in the process cartridge for the printer was removed, and the primary charging roller was replaced by a conona charger 901.

Further, the developing device (902) in the process cartridge was remodeled as follows. The stainless steel sleeve (toner-carrying member) was replaced by a toner-carrying member 904 in the form of a roller (diameter: 16 mm) comprising a foam urethane, which was abutted against a photosensitive drum (photosensitive member) 906. The toner carrying member 904 was designed to rotate in a direction of an arrow so as to provide a peripheral moving direction identical to that of the photosensitive drum 906 at the position of contact with the photosensitive drum 906 and a peripheral speed which was 160% of that of the photosensitive drum 906 (i.e., process speed of 47 mm/sec).

A developer application roller 905 was abutted against the toner-carrying member 904 as a means for applying a toner onto the toner-carrying member 904. Further, a resin-coated stainless steel blade 903 was disposed so as to regulate the toner coating layer on the toner-carrying member. The developing bias voltage was only a DC component of −300 volts. According to the remodeled apparatus, the photosensitive drum 906 was uniformly charged by a corona charger

TABLE 1

| Characteristic data for photosensitive members | | | | | | | | |
|---|---|---|---|---|---|---|---|---|
| Prod. Ex. No. | Vd (V) | Vr (V) | $\frac{(Vd+Vr)}{2}$ (V) | 1st slope $Vd-\frac{(Vd+Vr)}{2}$ (Vm$^2$/cJ) | 2nd slope = 1st slope / 20 (Vm$^2$/cJ) | Emin (cJ/m$^2$) | Emax (= 5 × E1/2) (cJ/m$^2$) | θ (deg.) |
| 1 | −700 | −55 | −378 | 2900 | 150 | 0.43 | 0.60 | 93 |
| 2 | −700 | −60 | −380 | 3200 | 160 | 0.40 | 0.60 | 101 |
| 3 | −700 | −20 | −360 | 640 | 32 | 2.45 | 2.85 | 96 |
| 4 | −700 | −15 | −358 | 560 | 28 | 2.80 | 3.10 | 74 |
| 5 | −700 | −60 | −380 | 2900 | 150 | 0.45 | 0.65 | 78 |
| 6 | −700 | −60 | −380 | 2900 | 150 | 0.45 | 0.65 | 77 |
| 7 | −700 | −55 | −378 | 920 | 46 | 1.60 | 1.90 | 77 |
| 8 | −700 | −15 | −358 | 570 | 29 | 2.80 | 3.05 | 76 |
| 9 | −700 | −55 | −378 | 2900 | 150 | 0.43 | 0.60 | 88 |

Developers were prepared according to the following Production Examples.

| (Production Example I) | |
|---|---|
| Polyester resin | 89 wt. % |
| Metal-containing azo dye | 2 wt. % |
| Carbon black | 6 wt. % |
| Polyolefin | 3 wt. % |

301 and then exposed to laser light so as to form a binary latent image at a resolution of 300 dpi. The latent image was then developed with a toner on the toner-carrying member 904 and the resultant toner image was transferred by a transfer roller 907 supplied with a voltage onto a transfer material 908.

Performance evaluation was basically performed in an environment of 25° C. and 50% relative humidity.

In this specific example (Example 1), the photosensitive member of Production Example 1 and the developer of Production Example I were used. The photosensitive member was charged to a dark-part potential of −700 volts. The evaluation was performed at exposure intensities of 0.45 $cJ/m^2$ and 0.55 $cJ/m^2$.

Figure 10:
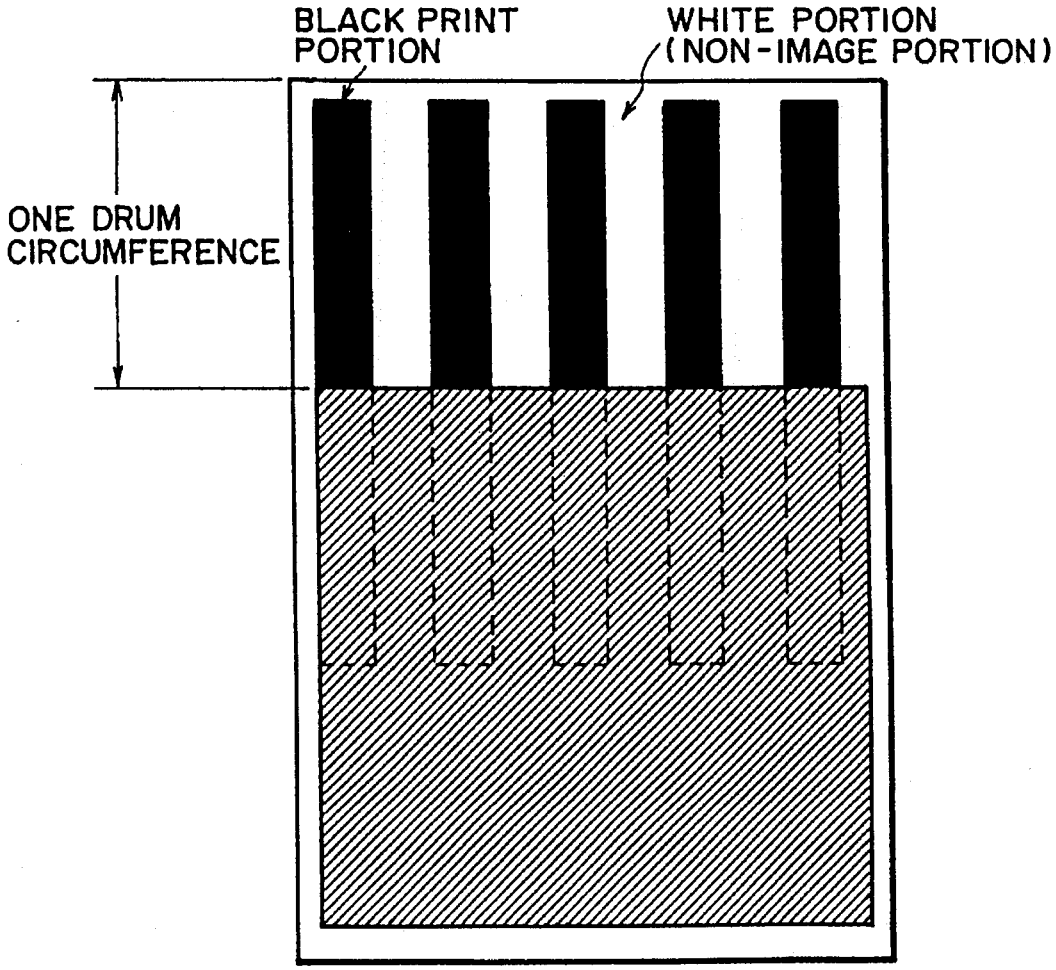
FIGS. 10–12 respectively illustrate an image pattern used in an Example appearing hereinafter.

Image evaluation was performed by using a test pattern as shown in FIG. 10 comprising black and white stripes in a first region having a vertical length of one drum circumference and a subsequent halftone image region (corresponding to second and subsequent drum circumferences) formed by repetition of one black dot line and two blank dot lines respectively running laterally.

Test transfer materials included a plain paper of 75 $g/m^2$, a thick paper of 130 $g/m^2$, a post card paper of 200 $g/m^2$ and an overhead projector film of polyethylene terephthalate.

Ghost image evaluation was performed by measuring reflection image densities by using a Macbeth reflection densitometer at portions in the second drum circumference region corresponding to the black print portion (black stripe portion) and the white print portion (white stripe portion) in the first drum circumference and taking a difference ad therebetween, i.e., according to the following formula:

$\Delta d$= (reflection density at a portion corresponding to a black stripe portion)−(reflection density at a portion corresponding to a white stripe (non-image) portion).

Figure 12:
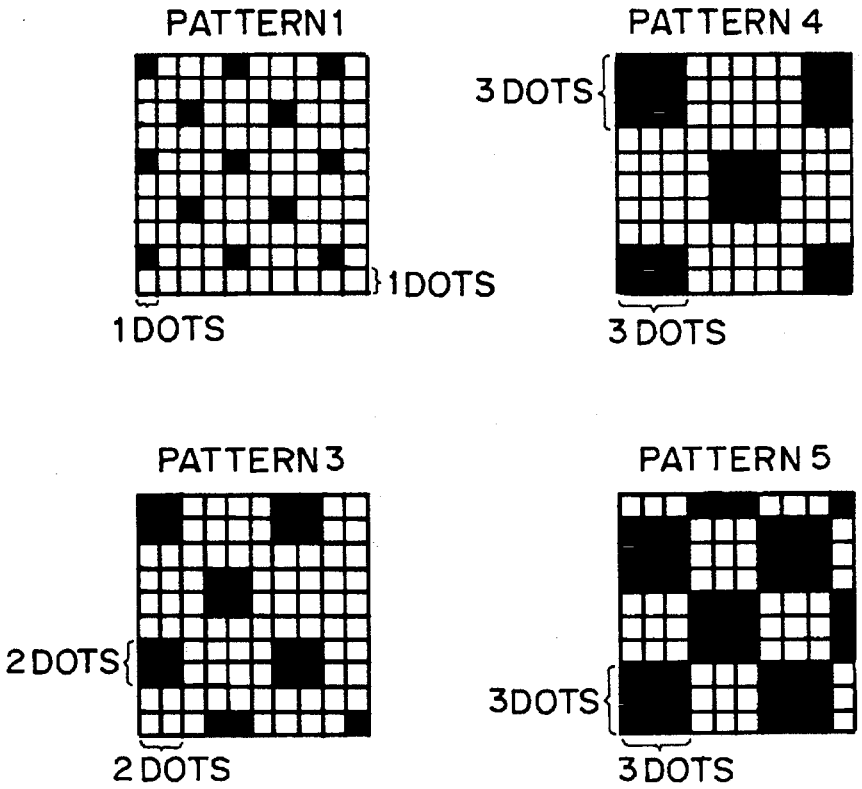

The results are shown in Table 2. A smaller reflection density difference $\Delta d$ represents a better ghost (prevention) performance. If $\Delta d$ is 0.03 or higher, a ghost image is noticeable with the eyes Gradation characteristic evaluation was performed by measuring image densities given by 8 dot arrangement patterns 1 to 8 (of which only patterns 1, 3, 4 and 5 are shown in FIG. 12). Incidentally, Pattern 2 is obtained by modifying pattern 1 (including 13 black dots in 100 dot region so as to replace one dot into 2×2 (=4) dots thereby providing 20 (=4×5) black dots in 100 dot region; Pattern 6 is obtained by modifying Pattern 5 (52/100 dots) so as to replace 3×3 dots unit with 2×2 dots, thereby providing 72/100 dots; Pattern 7 is given by one dot unit in Pattern 7; and Pattern 8 is given as a solid black pattern.

The eight patterns were designed to provide the following density ranges, respectively.

| | |
|---|---|
| pattern 1 | 0.10–0.15, |
| pattern 2 | 0.15–0.20, |
| pattern 3 | 0.20–0.30, |
| pattern 4 | 0.25–0.40, |
| pattern 5 | 0.55–0.70, |
| pattern 6 | 0.65–0.80, |
| pattern 7 | 0.75–0.90, |
| pattern 8 | 1.35– |

The gradation reproducibility was evaluated to be excellent if all the above ranges were satisfied, fair if only one range was not satisfied and poor if two or more ranges were not satisfied. The results are shown in Table 3 together with other Examples.

Individual dot reproducibility was evaluated by measuring the density of a reproduced image of Pattern 1. This is based on the fact that blurring of a latent image causes an enlarged developed area to provide an increased reproduced density. The evaluation was performed according to the following standards:

excellent: 0.10–0.15, fair: 0.16–0.17, poor: 0.18 or higher.

The results are shown in Table 2 together with other Examples.

Comparative Example 1

The tests in Example 1 were repeated except that the exposure intensities were changed to 0.25 $cJ/m^2$ and 0.85 $cJ/m^2$. The results are shown in Tables 2 and 3.

EXAMPLE 2

The apparatus used in Example 1 was modified so that the corona charger was replaced by the original roller charger and the charging roller was supplied with a DC voltage of −1400 volts.

The photosensitive member of Production Example 2 and the developer of Production Example I were used. The photosensitive member was charged to a dark potential of −700 volts and exposed at intensities of 0.45 $cJ/m^2$ and 0.55 $cJ/m^2$ to perform the tests otherwise in the same manner as in Example 1. The results are shown in Tables 2 and 3.

Comparative Example 2

The tests were performed in the same manner as in Example 2 except that the exposure intensities were changed to 0.25 $cJ/m^2$ and 0.85 $cJ/m^2$, respectively. The results are shown in Tables 2 and 3.

EXAMPLE 3

The same electrophotographic apparatus as in Example 1 was used together with the photosensitive member of Production Example 3 and the developer of Production Example I. The photosensitive member was charged to a dark-part potential of −700 volts and exposed at intensities of 2.50 $cJ/m^2$ and 2.70 $cJ/m^2$, respectively so as to effect the tests in the same manner as in Example 1. The results are shown in Tables 2 and 3.

Comparative Example 3

The tests were performed in the same manner as in Example 3 except that the exposure intensities were changed to 2.00 $cJ/m^2$ and 4.50 $cJ/m^2$, respectively. The results are shown in Tables 2 and 3.

EXAMPLE 4

The same electrophotographic apparatus as in Example 1 was used together with the photosensitive member of Production Example 9 and the developer of Production Example I. The photosensitive member was charged to dark-part potential of −700 volts and exposed at intensities of 0.45 $cJ/m^2$ and 0.55 $cJ/m^2$, respectively, so as to effect the tests in the same manner as in Example 1. The results are shown in Tables 2 and 3.

EXAMPLE 5

The electrophotographic apparatus used in Example 1 was modified by replacing the corona charger with a fur brush roller charger (planted fiber density $=1.5\times10^5$/inch$^2$) so that the fur brush roller charge supplied with a DC voltage of −1400 volts was abutted to the photosensitive member and rotated in a reverse direction at the abutting position with respect to the photosensitive member. The apparatus was used together with the photosensitive member of Production Example 1 and the developer of Production Example I. The photosensitive member was charged to a dark-part potential of −700 volts and exposed at intensities of 0.45 cJ/m$^2$ and 0.55 cJ/m$^2$, respectively, so as to effect the tests in the same manner as in Example 1. The results are shown in Tables 2 and 3.

EXAMPLE 6

A ghost evaluation test was performed in the same manner as in Example 1 except that the environment was changed to high temperature-high humidity of 32.5° C. −85%RH and the evaluation was performed on plain paper of 75 g/m$^2$ only as a transfer material. The results are shown in Table 4.

EXAMPLE 7

A ghost evaluation test was performed in the same manner as in Example 3 except that the environment was changed to high temperature-high humidity of 32.5° C. −85%RH and the evaluation was performed on plain paper of 75 g/m$^2$ only as a transfer material. The results are shown in Table 4.

Comparative Example 4

A ghost evaluation test was performed in the same manner as in Comparative Example 1 except that the environment was changed to high temperature-high humidity of 32.5° C. −85%RH and the evaluation was performed on plain paper of 75 g/m$^2$ only as a transfer material and at an exposure intensity of 0.25 cJ/m$^2$only. In the high temperature—high humidity environment, some ghost was observed even on the plain paper of 75 g/m$^2$. The results are shown in Table 4.

TABLE 2

| | Photosensitive member | Exposure intensiy (cJ/m$^2$) | Toner | Ghost evaluation Δd Paper 75 g/m$^2$ | 130 g/m$^2$ | 200 g/m$^2$ | OHP film | Dot reproducibility |
|---|---|---|---|---|---|---|---|---|
| Ex. 1 | Prod. Ex. 1 | 0.45 | Prod. | 0.00 | 0.00 | 0.00 | 0.00 | excellent |
| | | 0.55 | Ex. I | 0.00 | 0.00 | 0.00 | 0.00 | excellent |
| Comp. | Prod. Ex. 1 | 0.25 | Prod. | 0.00 | −0.02 | −0.03 | −0.03 | excellent |
| Ex. 1 | | 0.85 | Ex. I | 0.00 | 0.00 | 0.00 | 0.00 | poor |
| Ex. 2 | Prod. Ex. 2 | 0.45 | Prod. | 0.00 | 0.00 | 0.00 | 0.00 | excellent |
| | | 0.55 | Ex. I | 0.00 | 0.00 | 0.00 | 0.00 | excellent |
| Comp. | Prod. Ex. 2 | 0.25 | Prod. | 0.00 | −0.01 | −0.03 | −0.02 | excellent |
| Ex. 2 | | 0.85 | Ex. I | 0.00 | 0.0 | 0.00 | 0.00 | poor |
| Ex. 3 | Prod. Ex. 3 | 2.50 | Prod. | 0.00 | 0.00 | −0.01 | 0.00 | excellent |
| | | 2.70 | Ex. I | 0.00 | 0.00 | −0.01 | 0.00 | fair |
| Comp. | Prod. Ex. 3 | 2.00 | Prod. | 0.00 | −0.02 | −0.05 | −0.04 | excellent |
| Ex. 3 | | 4.50 | Ex. I | 0.00 | 0.00 | −0.01 | 0.00 | poor |
| Ex. 4 | Prod. Ex. 9 | 0.45 | Prod. | 0.00 | 0.00 | 0.00 | −0.01 | excellent |
| | | 0.55 | Ex. I | 0.00 | 0.00 | 0.00 | 0.00 | excellent |
| Ex. 5 | Prod. Ex. 1 | 0.45 | Prod. | 0.00 | 0.00 | 0.00 | 0.00 | excellent |
| | | 0.55 | Ex. I | 0.00 | 0.00 | 0.00 | 0.00 | excellent |

TABLE 3

| | Exposure intensity (cJ/m$^2$) | Gradation reproducibility | Densities for respective patterns 1 | 2 | 3 | 4 | 5 | 6 | 7 | 8 |
|---|---|---|---|---|---|---|---|---|---|---|
| Ex. 1 | 0.45 | excellent | 0.14 | 0.17 | 0.25 | 0.29 | 0.58 | 0.69 | 0.87 | 1.44 |
| | 0.55 | excellent | 0.15 | 0.18 | 0.27 | 0.32 | 0.61 | 0.73 | 0.89 | 1.45 |
| Comp. Ex. 1 | 0.25 | excellent | 0.12 | 0.15 | 0.22 | 0.26 | 0.55 | 0.65 | 0.81 | 1.44 |
| | 0.85 | poor | 0.18 | 0.19 | 0.31 | 0.35 | 0.71 | 0.87 | 1.21 | 1.45 |
| Ex. 2 | 0.45 | excellent | 0.14 | 0.17 | 0.26 | 0.33 | 0.60 | 0.74 | 0.87 | 1.46 |
| | 0.55 | fair | 0.14 | 0.19 | 0.28 | 0.37 | 0.68 | 0.79 | 0.90 | 1.45 |
| Comp. Ex. 2 | 0.25 | excellent | 0.13 | 0.17 | 0.23 | 0.32 | 0.59 | 0.69 | 0.80 | 1.45 |
| | 0.85 | poor | 0.19 | 0.23 | 0.35 | 0.48 | 0.99 | 1.19 | 1.30 | 1.45 |
| Ex. 3 | 2.50 | excellent | 0.14 | 0.20 | 0.27 | 0.34 | 0.59 | 0.77 | 0.82 | 1.45 |
| | 2.70 | fair | 0.15 | 0.20 | 0.28 | 0.36 | 0.64 | 0.79 | 0.99 | 1.45 |
| Comp. Ex. 3 | 2.00 | excellent | 0.13 | 0.17 | 0.25 | 0.33 | 0.58 | 0.74 | 0.80 | 1.45 |
| | 4.50 | poor | 0.18 | 0.23 | 0.39 | 0.50 | 1.09 | 1.21 | 1.37 | 1.45 |
| Ex. 4 | 0.45 | excellent | 0.13 | 0.16 | 0.24 | 0.27 | 0.56 | 0.66 | 0.85 | 1.44 |
| | 0.55 | excellent | 0.15 | 0.17 | 0.25 | 0.32 | 0.61 | 0.71 | 0.87 | 1.45 |
| Ex. 5 | 0.45 | excellent | 0.14 | 0.17 | 0.25 | 0.31 | 0.58 | 0.72 | 0.85 | 1.45 |
| | 0.55 | excellent | 0.14 | 0.19 | 0.28 | 0.37 | 0.66 | 0.78 | 0.89 | 1.45 |

TABLE 4

| | Photosensitive member | Exposure intensity ($cJ/m^2$) | Toner | Ghost evaluation, Δd at 32.5° C., 85% RH 75 $g/m^2$ paper |
|---|---|---|---|---|
| Ex. 6 | Prod. Ex. 1 | 0.45 | Prod. Ex. I | 0.00 |
| | | 0.55 | | 0.00 |
| Ex. 7 | Prod. Ex. 3 | 2.50 | Prod. Ex. I | 0.00 |
| | | 2.70 | | 0.00 |
| Comp. Ex. 4 | Prod. Ex. 1 | 0.25 | Prod. Ex. I | −0.02 |

EXAMPLE 8

The electrophotographic apparatus used in Example 1 was modified by replacing the 16 mm-dia. medium-resistivity rubber roller as a toner-carrying member with a 18 mm-dia. medium-resistivity rubber roller, and the roller was rotated at a peripheral speed of 140% of that of the photosensitive member and supplied with a developing bias of −400 volts DC. The apparatus was used together with the photosensitive member of Production Example 6 and the developer of Production Example I.

The photosensitive member was charged to a dark-part potential of −700 volts and exposed at intensities of 0.50 $cJ/m^2$ and 0.60 $cJ/m^2$, respectively, to effect the performance.

Figure 11:
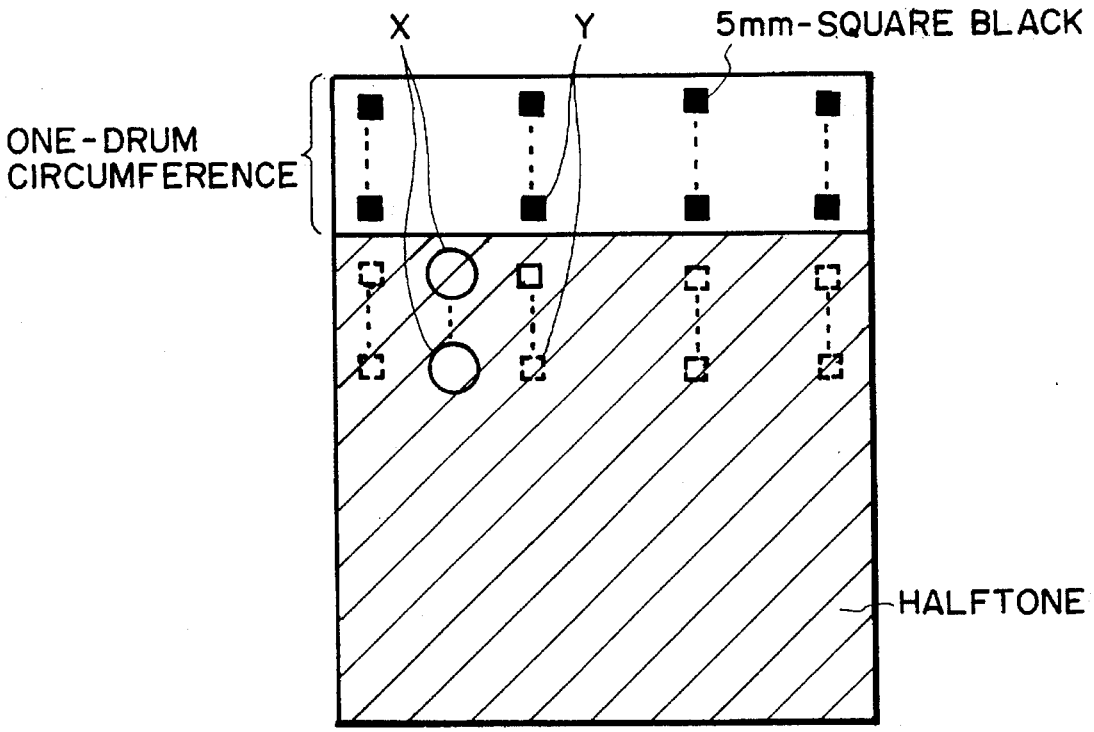

Ghost image evaluation was performed by using a test pattern as shown in FIG. 11 comprising black squares of 5×5 mm in a first region having a vertical length of one drum circumference and a subsequent halftone image region (corresponding to second and subsequent drum circumferences) formed by repetition of one black dot lines and two black dots lines respectively running laterally.

Test transfer materials included a plain paper of 75 $g/m^2$, a thick paper of 130 $g/m^2$ and an overhead projector film of polyethylene terephthalate.

Ghost image evaluation was performed by measuring reflection image densities by using a Macbeth reflection densitometer at portions Y and X in the second drum circumference region corresponding to the black print portion (black square portion) and the no print portion in the first drum circumference and taking a difference Δd therebetween similarly as in Example 1.

The gradation characteristic and dot reproducibility were also evaluated similarly as in Example 1.

The results are shown in Tables 5 and 6.

Comparative Example 5

The tests were performed in the same manner as in Example 8 except that the exposure intensities were changed to 0.35 $cJ/m^2$ and 0.90 $cJ/m^2$, respectively. The results are shown in Tables 5 and 6.

EXAMPLE 9

The same electrophotographic apparatus as in Example 8 was used together with the photosensitive member of Production Example 7 and the developer of Production Example II. The photosensitive member was charged to a dark-part potential of −700 volts and exposed at intensities of 1.65 $cJ/m^2$ and 1.85 $cJ/m^2$, respectively so as to effect the tests in the same manner as in Example 8. The results are shown in Tables 5 and 6.

Comparative Example 6

The tests were performed in the same manner as in Example 9 except that the exposure intensities were changed to 1.30 $cJ/m^2$ and 2.66 $cJ/m^2$, respectively. The results are shown in Tables 5 and 6.

EXAMPLE 10

The same electrophotographic apparatus as in Example 8 was used together with the photosensitive member of Production Example 8 and the developer of Production Example II. The photosensitive member was charged to dark-part potential of −700 volts and exposed at intensities of 2.85 $cJ/m^2$ and 3.00 $cJ/m^2$, respectively, so as to effect the tests in the same manner as in Example 8. The results are shown in Tables 5 and 6.

Comparative Example 7

The tests were performed in the same manner as in Example 10 except that the exposure intensities were changed to 2.50 $cJ/m^2$ and 4.30 $cJ/m^2$, respectively. The results are shown in Tables 5 and 6.

TABLE 5

| | Photosensitive member | Exposure intensiy ($cJ/m^2$) | Toner | Ghost evaluation Δd Paper 75 $g/m^2$ | Paper 130 $g/m^2$ | OHP film | Dot reproducibility |
|---|---|---|---|---|---|---|---|
| Ex. 8 | Prod. Ex. 6 | 0.50 | Prod. Ex. II | 0.00 | 0.00 | −0.01 | excellent |
| | | 0.60 | | 0.00 | 0.00 | −0.01 | excellent |
| Comp. Ex. 5 | Prod. Ex. 6 | 0.35 | Prod. Ex. II | 0.00 | −0.03 | −0.07 | excellent |
| | | 0.90 | | 0.00 | 0.00 | 0.00 | poor |
| Ex. 9 | Prod. Ex. 7 | 1.65 | Prod. Ex. II | 0.00 | 0.00 | −0.02 | excellent |
| | | 1.85 | | 0.00 | 0.00 | −0.02 | excellent |
| Comp. | Prod. Ex. 7 | 1.30 | Prod. Ex. II | −0.01 | −0.05 | −0.06 | excellent |

TABLE 5-continued

| | Photosensitive member | Exposure intensiy (cJ/m²) | Toner | Ghost evaluation Δd Paper 75 g/m² | Paper 130 g/m² | OHP film | Dot reproducibility |
|---|---|---|---|---|---|---|---|
| Ex. 6 | | 2.66 | | 0.00 | −0.01 | −0.01 | poor |
| Ex. 10 | Prod. Ex. 8 | 2.85 | Prod. Ex. II | 0.00 | −0.02 | −0.02 | excellent |
| | | 3.00 | | 0.00 | −0.02 | −0.03 | fair |
| Comp. Ex. 7 | Prod. Ex. 8 | 2.50 | Prod. Ex. II | −0.02 | −0.06 | −0.09 | excellent |
| | | 4.30 | | 0.00 | −0.02 | −0.03 | poor |

TABLE 6

| | Exposure intensity (cJ/m²) | Gradation reproducibility | Densities for respective patterns 1 | 2 | 3 | 4 | 5 | 6 | 7 | 8 |
|---|---|---|---|---|---|---|---|---|---|---|
| Ex. 8 | 0.50 | excellent | 0.13 | 0.16 | 0.24 | 0.28 | 0.57 | 0.67 | 0.85 | 1.44 |
| | 0.60 | excellent | 0.15 | 0.18 | 0.27 | 0.32 | 0.61 | 0.73 | 0.89 | 1.45 |
| Comp. Ex. 5 | 0.35 | excellent | 0.13 | 0.16 | 0.24 | 0.28 | 0.56 | 0.65 | 0.83 | 1.44 |
| | 0.90 | poor | 0.18 | 0.19 | 0.31 | 0.35 | 0.71 | 0.87 | 1.21 | 1.45 |
| Ex. 9 | 1.65 | excellent | 0.14 | 0.17 | 0.26 | 0.33 | 0.60 | 0.74 | 0.87 | 1.46 |
| | 1.85 | fair | 0.14 | 0.19 | 0.28 | 0.34 | 0.65 | 0.78 | 0.94 | 1.45 |
| Comp. Ex. 6 | 1.30 | excellent | 0.13 | 0.15 | 0.23 | 0.31 | 0.59 | 0.70 | 0.79 | 1.45 |
| | 2.66 | poor | 0.18 | 0.20 | 0.34 | 0.45 | 0.98 | 1.10 | 1.29 | 1.45 |
| Ex. 10 | 2.85 | excellent | 0.14 | 0.20 | 0.28 | 0.33 | 0.59 | 0.76 | 0.80 | 1.45 |
| | 3.00 | fair | 0.15 | 0.20 | 0.28 | 0.36 | 0.68 | 0.79 | 0.99 | 1.45 |
| Comp. Ex. 7 | 2.50 | excellent | 0.13 | 0.18 | 0.25 | 0.34 | 0.62 | 0.74 | 0.88 | 1.45 |
| | 4.30 | poor | 0.18 | 0.22 | 0.38 | 0.50 | 1.01 | 1.16 | 1.30 | 1.45 |

What is claimed is:

1. An image forming method, comprising:

a charging step of charging an electrophotographic photosensitive member, an exposure step of exposing the charged photosensitive member to form an electrostatic latent image thereon, a developing step of developing the electrostatic latent image with a toner to form a toner image, and a transfer step of transferring the toner image onto a transfer material, residual toner remaining on the photosensitive member after the transfer step being recovered in the developing step, wherein the photosensitive member is exposed in the exposure step at an exposure intensity which is at least a minimum exposure intensity and below a maximum exposure intensity; said minimum exposure intensity being determined on a surface potential-exposure intensity characteristic curve of the photosensitive member by determining a first slope S1 of a straight line connecting a point giving a dark part potential Vd and a point giving a value of (Vd+ a residual potential Vr)/2, determining a contact point between a tangent line having a slope of S1/20 and the surface potential-exposure intensity characteristic curve and determining the minimum exposure intensity as an exposure intensity at the contact point; said maximum exposure intensity being determined as 5 times a half-attenuation exposure intensity.

2. An image forming method according to claim 1, wherein the photosensitive member has a surface showing a contact angle of at least 85 degrees with water.

3. An image forming method according to claim 2, wherein the photosensitive member has a surface showing a contact angle of at least 90 degrees with water.

4. An image forming method according to any of claims 1 to 3, wherein the half-attenuation exposure intensity is at most 0.5 cJ/m².

5. An image forming method according to any of claims 1 to 3, wherein the half-attenuation exposure intensity is at most 0.3 cJ/m².

6. An image forming method according to any of claims 1 to 3, wherein the photosensitive member has a surface layer comprising a fluorine-containing resin powder.

7. An image forming method according to any of claims 1 to 3, wherein the electrostatic image is developed according to a reversal development mode in the developing step.

8. An image forming method according to any of claims 1 to 3, wherein the photosensitive member is charged by means of a brush in the charging step.

9. An image forming method according to any of claims 1 to 3, wherein the photosensitive member is exposed by a binary exposure mode.

10. An image forming method according to claim 4, wherein the photosensitive member has a surface layer comprising a fluorine-containing resin powder.

11. An image forming method according to claim 5, wherein the photosensitive member has a surface layer comprising a fluorine-containing resin powder.

12. An image forming method according to claim 4, wherein the electrostatic image is developed according to a reversal development mode in the developing step.

13. An image forming method according to claim 5, wherein the electrostatic image is developed according to a reversal development mode in the developing step.

14. An image forming method according to claim 6, wherein the electrostatic image is developed according to a reversal development mode in the developing step.

15. An image forming method according to claim 10, wherein the electrostatic image is developed according to a reversal development mode in the developing step.

16. An image forming method according to claim 11, wherein the electrostatic image is developed according to a reversal development mode in the developing step.

17. An image forming method according to claim 4, wherein the photosensitive member is charged by means of a brush in the charging step.

18. An image forming method according to claim 5, wherein the photosensitive member is charged by means of a brush in the charging step.

19. An image forming method according to claim 6, wherein the photosensitive member is charged by means of a brush in the charging step.

20. An image forming method according to claim 7, wherein the photosensitive member is charged by means of a brush in the charging step.

21. An image forming method according to claim 10, wherein the photosensitive member is charged by means of a brush in the charging step.

22. An image forming method according to claim 11, wherein the photosensitive member is charged by means of a brush in the charging step.

23. An image forming method according to claim 12, wherein the photosensitive member is charged by means of a brush in the charging step.

24. An image forming method according to claim 13, wherein the photosensitive member is charged by means of a brush in the charging step.

25. An image forming method according to claim 14, wherein the photosensitive member is charged by means of a brush in the charging step.

26. An image forming method according to claim 15, wherein the photosensitive member is charged by means of a brush in the charging step.

27. An image forming method according to claim 16, wherein the photosensitive member is charged by means of a brush in the charging step.

28. An image forming method according to claim 4, wherein the photosensitive member is exposed by a binary exposure mode.

29. An image forming method according to claim 5, wherein the photosensitive member is exposed by a binary exposure mode.

30. An image forming method according to claim 6, wherein the photosensitive member is exposed by a binary exposure mode.

31. An image forming method according to claim 7, wherein the photosensitive member is exposed by a binary exposure mode.

32. An image forming method according to claim 8, wherein the photosensitive member is exposed by a binary exposure mode.

33. An image forming method according to claim 10, wherein the photosensitive member is exposed by a binary exposure mode.

34. An image forming method according to claim 11, wherein the photosensitive member is exposed by a binary exposure mode.

35. An image forming method according to claim 12, wherein the photosensitive member is exposed by a binary exposure mode.

36. An image forming method according to claim 13, wherein the photosensitive member is exposed by a binary exposure mode.

37. An image forming method according to claim 14, wherein the photosensitive member is exposed by a binary exposure mode.

38. An image forming method according to claim 15, wherein the photosensitive member is exposed by a binary exposure mode.

39. An image forming method according to claim 16, wherein the photosensitive member is exposed by a binary exposure mode.

40. An image forming method according to claim 17, wherein the photosensitive member is exposed by a binary exposure mode.

41. An image forming method according to claim 18, wherein the photosensitive member is exposed by a binary exposure mode.

42. An image forming method according to claim 19, wherein the photosensitive member is exposed by a binary exposure mode.

43. An image forming method according to claim 20, wherein the photosensitive member is exposed by a binary exposure mode.

44. An image forming method according to claim 21, wherein the photosensitive member is exposed by a binary exposure mode.

45. An image forming method according to claim 22, wherein the photosensitive member is exposed by a binary exposure mode.

46. An image forming method according to claim 23, wherein the photosensitive member is exposed by a binary exposure mode.

47. An image forming method according to claim 24, wherein the photosensitive member is exposed by a binary exposure mode.

48. An image forming method according to claim 25, wherein the photosensitive member is exposed by a binary exposure mode.

49. An image forming method according to claim 26, wherein the photosensitive member is exposed by a binary exposure mode.

50. An image forming method according to claim 27, wherein the photosensitive member is exposed by a binary exposure mode.

* * * * *

UNITED STATES PATENT AND TRADEMARK OFFICE

CERTIFICATE OF CORRECTION

PATENT NO. : 5,576,810 Page 1 of 3

DATED : November 19, 1996

INVENTOR(S) : SHUICHI AITA, ET AL.

It is certified that error appears in the above-indentified patent and that said Letters Patent is hereby corrected as shown below:

IN THE DRAWINGS:

SHEET 10, FIGURE 11

"1 DOTS" (both occurrences) should read --1 DOT--.

COLUMN 1:

Line 16, "is," should read --is--.

COLUMN 3:

Line 62, "with" should read --by--.

COLUMN 5:

Line 46, "conductive fine" should be deleted.

COLUMN 6:

Line 34, "being able to prevent" should read --preventing--.

UNITED STATES PATENT AND TRADEMARK OFFICE

CERTIFICATE OF CORRECTION

PATENT NO. : 5,576,810 Page 2 of 3

DATED : November 19, 1996

INVENTOR(S) : SHUICHI AITA, ET AL.

It is certified that error appears in the above-indentified patent and that said Letters Patent is hereby corrected as shown below:

COLUMN 8:

Line 15, "simultaneous" should read --simultaneously--.

Line 45, "pigment, dye" should read --pigment dye,--.

COLUMN 11:

Line 6, "the" should read --then--.

COLUMN 12:

Line 29, "conona" should read --corona--.

COLUMN 13:

Line 29, "ad" should read --Δd--.

UNITED STATES PATENT AND TRADEMARK OFFICE

CERTIFICATE OF CORRECTION

PATENT NO. : 5,576,810 Page 3 of 3

DATED : November 19, 1996

INVENTOR(S) : SHUICHI AITA, ET AL.

It is certified that error appears in the above-indentified patent and that said Letters Patent is hereby corrected as shown below:

COLUMN 17:

Line 44, delete "ther-".
Line 45, "ebetween" should read --therebetween--.

COLUMN 18:

TABLE 5

"intensiy" should read --intensity--.

COLUMN 19:

TABLE 5

"intensiy" should read --intensity--.

Signed and Sealed this

Thirteenth Day of May, 1997

Bruce Lehman

*Attest:*

BRUCE LEHMAN

*Attesting Officer*

*Commissioner of Patents and Trademarks*